US008020237B2

(12) United States Patent
Boatman

(10) Patent No.: US 8,020,237 B2
(45) Date of Patent: Sep. 20, 2011

(54) APPARATUS FOR CLEANING PROCESS SURFACES

(75) Inventor: Donn Nathan Boatman, Union, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 1072 days.

(21) Appl. No.: 11/728,085

(22) Filed: Mar. 23, 2007

(65) Prior Publication Data

US 2007/0221248 A1 Sep. 27, 2007

Related U.S. Application Data

(60) Provisional application No. 60/785,167, filed on Mar. 23, 2006.

(51) Int. Cl.
*B08B 1/04* (2006.01)

(52) U.S. Cl. ..... 15/21.1; 15/179

(58) Field of Classification Search ..... 15/179, 15/22.1, 21.1

See application file for complete search history.

(56) References Cited

U.S. PATENT DOCUMENTS

| | | | | |
|---|---|---|---|---|
| 2,701,739 | A * | 2/1955 | Enchelmaier | 300/2 |
| 3,246,931 | A * | 4/1966 | Enchelmaier et al. | 300/2 |
| 3,291,678 | A | 12/1966 | Enloe et al. | |
| 3,890,984 | A * | 6/1975 | Lesetar | 132/271 |
| 4,126,358 | A * | 11/1978 | Enchelmaier | 300/21 |
| 4,277,708 | A | 7/1981 | McNab et al. | |
| 4,936,027 | A * | 6/1990 | Tsuji | 34/90 |
| 5,607,553 | A | 3/1997 | Chadha | |
| 5,649,478 | A | 7/1997 | Chadha | |
| 5,662,758 | A * | 9/1997 | Hamilton et al. | 156/221 |
| 5,871,607 | A * | 2/1999 | Hamilton et al. | 156/221 |
| 5,965,235 | A * | 10/1999 | McGuire et al. | 428/156 |
| 6,136,147 | A | 10/2000 | Edwards et al. | |
| 6,193,918 | B1 * | 2/2001 | McGuire et al. | 264/167 |
| 6,194,062 | B1 * | 2/2001 | Hamilton et al. | 428/343 |
| 6,248,407 | B1 | 6/2001 | Hess | |
| 6,280,574 | B1 | 8/2001 | Bauer | |
| 6,421,052 | B1 * | 7/2002 | McGuire | 345/441 |
| 6,489,022 | B1 * | 12/2002 | Hamilton et al. | 428/343 |
| 6,503,325 | B1 | 1/2003 | Hess | |
| 6,804,856 | B2 | 10/2004 | Udall | |
| 2003/0041880 | A1 | 3/2003 | Udall | |
| 2004/0074981 | A1 | 4/2004 | Hamel et al. | |
| 2005/0183752 | A1 | 8/2005 | Williams | |

FOREIGN PATENT DOCUMENTS

| | | | |
|---|---|---|---|
| GB | 2 155 825 | | 10/1985 |
| JP | 07313240 | A | 12/1995 |
| JP | 11056239 | A | 3/1999 |
| JP | 2000-121400 | A | 4/2000 |
| KR | 30252865 | A | 6/2003 |
| WO | WO 2004/094078 | A1 | 11/2004 |

* cited by examiner

*Primary Examiner* — Shay Karls
(74) *Attorney, Agent, or Firm* — Roddy M. Bullock; Betty J. Zea

(57) ABSTRACT

A brush, as well as a method for cleaning a process surface using the brush, having: a hollow cylinder having a closed first end, a closed second end, and a peripheral wall with an internal and external surface; with bristles arranged on the external surface of the peripheral wall thereof; wherein the hollow cylinder has a plurality of apertures formed in the peripheral wall for permitting a gas or liquid to emerge from the interior of the hollow cylinders to the vicinity of the bristles; wherein the apertures are arranged in a staggered multi helical pattern having from about 3 to about 15 helix; and wherein the peripheral wall has a surface area ratio of from about 6 to about 30.

11 Claims, 7 Drawing Sheets

| Fig. 4A | Fig. 4B |
|---|---|

Fig. 4

Diameter 2.556
In

| Circumfrence | %In | 0.00 | 0.75 | 1.50 | 2.25 | 3.00 | 3.75 | 4.50 | 5.25 | 6.00 | 6.75 | 7.50 | 8.25 |
|---|---|---|---|---|---|---|---|---|---|---|---|---|---|
| 0 | 0° | Home | 1 | | | 3 | | | 2 | | | 1 | |
| | | Collar | | | | | | | | | | | |
| | | | | | | | | | | | | | |
| 2.6753186 | 120° | | | 2 | | | 1 | | | 3 | | | 2 |
| | | | | | | | | | | | | | |
| | | | | | | | | | | | | | |
| 5.35063721 | 240° | | | | 3 | | | 2 | | | 1 | | |
| | | | | | | | | | | | | | |
| | | | | | | | | | | | | | |
| 8.02595581 | 360° | | 1 | | | 3 | | | 2 | | | 1 | |

| | |
|---|---|
| Helical Strands | 4 |
| Circumferential offse beween helical rows - strands | 120° |
| Orifice spacing within a helix - | 3.000 |
| Lateral offset between helical rows - strands | 0.750 |

Fig. 4A

| Fig. 5A | Fig. 5B |
|---|---|

Fig. 5

Diameter 3.195
In

| Circumfrence | °/in | 0.00 | 0.48 | 0.96 | 1.44 | 1.92 | 2.40 | 2.88 | 3.36 | 3.84 | 4.32 | 4.80 | 5.28 |
|---|---|---|---|---|---|---|---|---|---|---|---|---|---|
| 0 | 0° | Home | 1 | | | | 5 | | | | 4 | | |
| | | Collar | | | | | | | | | | | |
| | | | | | | | | | | | | | |
| | | | | | | | | | | | | | |
| 2.50811103 | 90° | | | 2 | | | | 1 | | | | 5 | |
| | | | | | | | | | | | | | |
| | | | | | | | | | | | | | |
| | | | | | | | | | | | | | |
| 5.01622206 | 180° | | | | 3 | | | | 2 | | | | 1 |
| | | | | | | | | | | | | | |
| | | | | | | | | | | | | | |
| | | | | | | | | | | | | | |
| 7.52433309 | 270° | | | | | 4 | | | | 3 | | | |
| | | | | | | | | | | | | | |
| | | | | | | | | | | | | | |
| | | | | | | | | | | | | | |
| 10.0324441 | 360° | | | | | | 5 | | | | 4 | | |

Helical Strands 5
Circumferential offse beween helical rows - strands 90°
Orifice spacing within a helix - 2.400
Lateral offset between helical rows - strands 0.480

Fig. 5A

| 5.76 | 6.24 | 6.72 | 7.20 | 7.68 | 8.16 | 8.64 | 9.12 | 9.60 | 10.08 | 10.56 | 11.04 | 11.52 | 12.00 |
|---|---|---|---|---|---|---|---|---|---|---|---|---|---|
| | 3 | | | | 2 | | | | 1 | | | | 5 |
| | | | | | | | | | | | | | |
| | | | | | | | | | | | | | |
| | | | | | | | | | | | | | |
| | | 4 | | | | 3 | | | | 2 | | | |
| | | | | | | | | | | | | | |
| | | | | | | | | | | | | | |
| | | | | | | | | | | | | | |
| | | | 5 | | | | 4 | | | | 3 | | |
| | | | | | | | | | | | | | |
| | | | | | | | | | | | | | |
| | | | | | | | | | | | | | |
| 2 | | | | 1 | | | | 5 | | | | 4 | |
| | | | | | | | | | | | | | |
| | | | | | | | | | | | | | |
| | | | | | | | | | | | | | |
| | 3 | | | | 2 | | | | 1 | | | | 5 |

Fig. 5B

APPARATUS FOR CLEANING PROCESS SURFACES

CROSS REFERENCE TO RELATED APPLICATION

This application claims the benefit of U.S. Provisional Application No. 60/785,167, filed Mar. 23, 2006.

FIELD OF THE INVENTION

This invention relates to the cleaning of surfaces, especially embossing or printing plate surfaces used in the production of paper products or surfaces used in the production of polymeric film products.

BACKGROUND OF THE INVENTION

This invention relates to the cleaning of surfaces, especially embossing surfaces or the surfaces of printing plates used for example, in the production and converting of paper products and/or polymeric film products. The invention is especially useful for cleaning steel embosser rolls used to emboss paper for tissue and towel products. This invention, however, is also useful in the cleaning of other surfaces, e.g. printing plates, rubber marrying rolls, embossing rolls, etc.

Process surfaces used to produce polymeric films, tissue and towel paper products, accumulate by products of the process such as glue deposits, residual paper fiber, and residual polymeric material on the process surfaces. This build up of by products may create defects in the finished product. This is especially true when steel embosser rolls are used to create deep embossing in paper towel products.

The prior art teaches the use of cleaning processes and cleaning brushes to remove this build up on processing surfaces. For example, the prior art teaches the use of water or steam delivered via an internal manifold on a cleaning brush to prevent or remove contamination build up on surfaces. In particular U.S. Pat. No. 6,804,856, Udall, discloses an apparatus for cleaning a surface, comprising a brush, the brush being in the form of a drum wherein steam is used in association with the drum, and the brush may be disposed within a hood with an extraction system. These standard type brushes, however, cause several problems. The steam or water may quickly saturate isolated areas of the brush causing excessive sling. Furthermore, because the water or steam is not evenly distributed to the brush bristles, the water or steam will not be evenly distributed to the process surface. In addition, excessive water may also build up where the inner manifold lines up with the orifices of the core leaving adjacent orifices dry. Both of these deficiencies lead to less effective or ineffective cleaning via the brush.

Furthermore, unreliable prior art cleaning methods sometime require removal of the contaminated process surfaces from the production line for cleaning by hand. This is expensive, time consuming, and inconvenient. Moreover, removal of plates and embosser rolls may also require use of temporary or replacement rolls/plates while the cleaning is underway. Again this is time consuming and expensive.

The present invention overcomes the above described deficiencies of the prior art for cleaning these process surfaces. The present invention provides superior cleaning of process surfaces through the arrangement and size of apertures, wherein the apertures are arranged in a staggered multi helical pattern comprising from about 3 to about 15 helixes; and wherein the peripheral wall has a surface area ratio of from about 6 to about 30.

SUMMARY OF THE INVENTION

The present invention relates to a brush for cleaning a surface comprising:

hollow cylinder having a closed first end, a closed second end, and a peripheral wall having an internal surface and an external surface; a plurality of bristles arranged on the external surface of the peripheral wall;

wherein the hollow cylinder comprises a plurality of apertures formed in the peripheral wall and extending therethrough for permitting a gas or liquid to emerge from the interior of the hollow cylinder to the bristles and wherein the peripheral wall has a surface area ratio of from about 6 to about 30;

wherein the apertures are arranged in a staggered multi helical pattern comprising from about 3 to about 15 helixes.

The present invention further relates to a method for cleaning a surface comprising;

providing a surface to be cleaned;

contacting the surface with bristles of a brush comprising:

- a hollow cylinder having a closed first end, a closed second end, and a peripheral wall having an internal surface and an external surface;
- a plurality of bristles arranged on the external surface of the peripheral wall;
- wherein the hollow cylinder comprises a plurality of apertures formed in the peripheral wall, the apertures arranged in a staggered multi helical pattern comprising from about 3 to about 15 helixes; wherein the peripheral wall has a surface area ratio of from about 6 to about 30;

delivering a gas or a liquid to the interior of the hollow cylinder whereby the gas or liquid is delivered in the vicinity of the bristles through the apertures; and effecting the movement of the bristles relative to the surface to provide an agitating cleaning action thereon.

BRIEF DESCRIPTION OF THE DRAWINGS

While the specification concludes with claims that particularly point out and distinctly claim the present invention, it is believed that the present invention will be understood better from the following description of embodiments, taken in conjunction with the accompanying drawings, in which like reference numerals identify identical elements.

Without intending to limit the invention, the present invention is described in more detail below.

FIG. 4 is too large for one sheet, it is shown on two sheets as FIG. 4A and FIG. 4B, with FIG. 4B being a continuation of the pattern representation of FIG. 4A.

FIG. 5 is a view of an example of a penta helix pattern that may be useful for the brush of the present invention, with a length of approximately 100 inches and a core diameter of approximately 3.195 inches. Because FIG. 5 is too large for one sheet, it is shown on two sheets as FIG. 5A and FIG. 5B, with FIG. 5B being a continuation of the pattern representation of FIG. 5A.

DEFINITIONS

Figure 1:
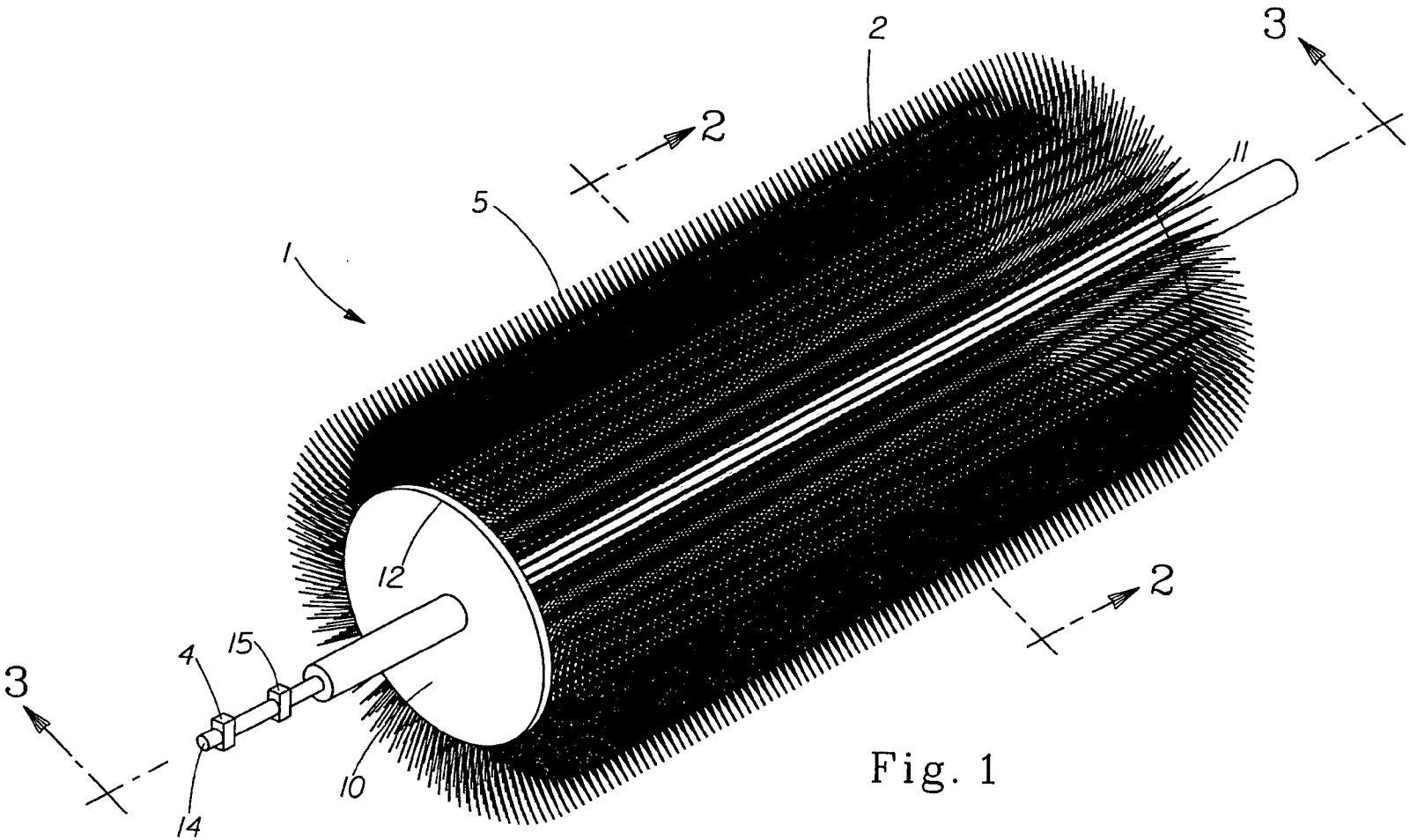
FIG. 1 is a perspective view of the brush of the present invention indicating cross sections indicated as 2-2 and 3-3.

As used herein "staggered multi helical pattern" means that the spacing between each aperture within the same helix strand is similar (in one embodiment varies no more than about 30%, about 20% and/or about 10%) and/or substantially equal measured laterally; the spacing between each adjacent helix strand is similar (in one embodiment varies no more than about 30%, about 20% and/or about 10%) and/or substantially equal; and the starting point for each helix relative to the first edge of the peripheral wall of the hollow cylinder of the brush is different for each adjacent helix. In one embodiment the starting point of the first helix strand at 0 degrees peripheral edge circumference is x, and the second helix strand is 2x, the third helix strand is 3x, the forth helix strand is 4x, etc.; wherein x may be about 0.1, 0.2, 0.25, 0.3, 0.4, 0.5, 0.6, 0.7, 0.8, 0.9, 1.0, inches, etc.

In one embodiment for a staggered multi helical pattern comprising a quadra helix pattern the starting point is 0.5 inches at 0 degrees peripheral edge circumference, 1 inch at 90 degrees peripheral edge circumference, 1.5 inches at 180 degrees peripheral edge circumference, and 2 inches at 270 degrees peripheral edge circumference. In one embodiment for a staggered multi helical pattern comprising a quadra helix pattern the starting point is 0.75 inches at 0 degrees peripheral edge circumference, 1.5 inches at 90 degrees peripheral edge circumference, 2.25 inches at 180 degrees peripheral edge circumference, and 3 inches at 270 degrees peripheral edge circumference. In one embodiment for a staggered multi helical pattern comprising a penta helix pattern the starting point is 0.48 inches at 0 degrees peripheral edge circumference, 0.96 inches at 90 degrees peripheral edge circumference, 1.44 inches at 180 degrees peripheral edge circumference, and 1.92 inches at 270 degrees peripheral edge circumference, and 2.4 inches at 360 degrees peripheral edge circumference. In yet another embodiment the staggered multi helical pattern for a hexa helix pattern the starting point is 0.333 inch at 0 degrees peripheral edge circumference, 0.667 inch at 72 degrees peripheral edge circumference, 1.00 inches at 144 degrees peripheral edge circumference, 1.33 inches at 216 degrees peripheral edge circumference, 1.667 inches at 288 degrees peripheral edge circumference, and 2.00 inches at 360 degrees peripheral edge circumference.

The term "deformable material" is intended to include foils, polymer webs, cloth, wovens, nonwovens, paper, paper boards, cellulose fiber webs, starch and starch substrates, knit fabrics, co-extrusions, laminates, polymeric films, and combinations thereof. The properties of a selected deformable material can include, though are not restricted to, combinations or degrees of being: porous, non-porous, microporous, gas or liquid permeable, non-permeable, hydrophilic, hydrophobic, hydroscopic, oleophilic, oleophobic, high critical surface tension, low critical surface tension, surface pre-textured, elastically yieldable, plastically yieldable, electrically conductive, and electrically non-conductive. Exemplary materials include wood, metal, rigid polymer stock, ceramic, glass, cured resin, thermoset materials, cross-linked materials, rubber, concrete, cement, stone, man-made materials, etc. Such materials can be homogeneous or composition combinations.

DETAILED DESCRIPTION OF THE INVENTION

The present invention provides an improved brush and method for cleaning a surface for example a process surface for making tissue and towel paper products such as steel emboss rolls, conveyor belts, marrying rolls, printing plates, or a process surface for manufacturing or embossing deformable materials or polymeric films. The particular features of the invention whereby such an improvement is achieved will be referred to herein.

Referring to FIG. 1, in one embodiment, the bristle carrying brush 1 is in the form of a hollow cylinder 2 having bristles 5 and a closed first end 10 and a closed second end 11. The brush 1 further comprises a first edge 12 of the peripheral wall 7 (not shown in FIG. 1). The brush 1 comprises a plurality of apertures 20 (not shown in FIG. 1 due to the presence of the bristles 5.). Steam may be delivered to the inside of the hollow cylinder 2 by an inlet pipe 14. The inlet pipe 14 has a steam delivery valve 4 and a shut off valve 15 all of which provides for steam (or other gas or liquid) to be passed therethrough and into the inside of the hollow cylinder so that it will emerge via the apertures 20 in the vicinity of the bristles 5. The bristle-carrying brush 1 in generally supported for rotation and drivable about its longitudinal axis so that the bristles 5 are operable on a process surface lying substantially parallel to the axis of the brush. In one embodiment the method further comprises a shut off value 15 to initiate and cut off the supply of steam at the beginning and the end of each cleaning cycle.

Figure 2:
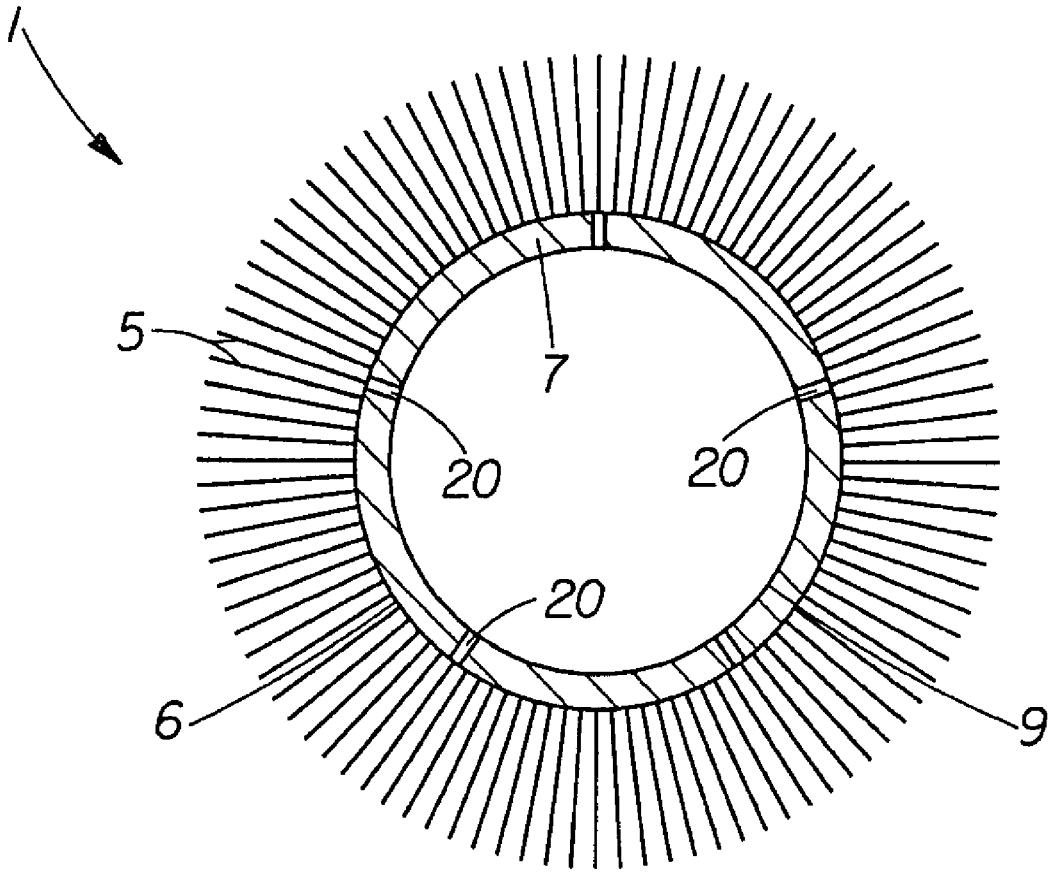
FIG. 2 is a cross-sectional view of the brush of FIG. 1 along 2-2.

FIG. 2 is a cross-sectional view of the brush of FIG. 1 along 2-2. Referring to FIG. 2, the peripheral wall 7 has an external surface 6 and an internal surface 9. Bristles 5 extend from the external surface 6 of the peripheral wall 7. The apertures 20 extends completely through the peripheral wall 7 of the hollow cylinder of the brush, from the internal surface 9 to the external surface 6. The apertures 20 allow for steam to pass from the interior of the hollow cylinder of brush 1, through the apertures 20 and emerge in the vicinity of the bristles 5 which are carried on the external surface 6 of the peripheral wall 7.

Figure 3:
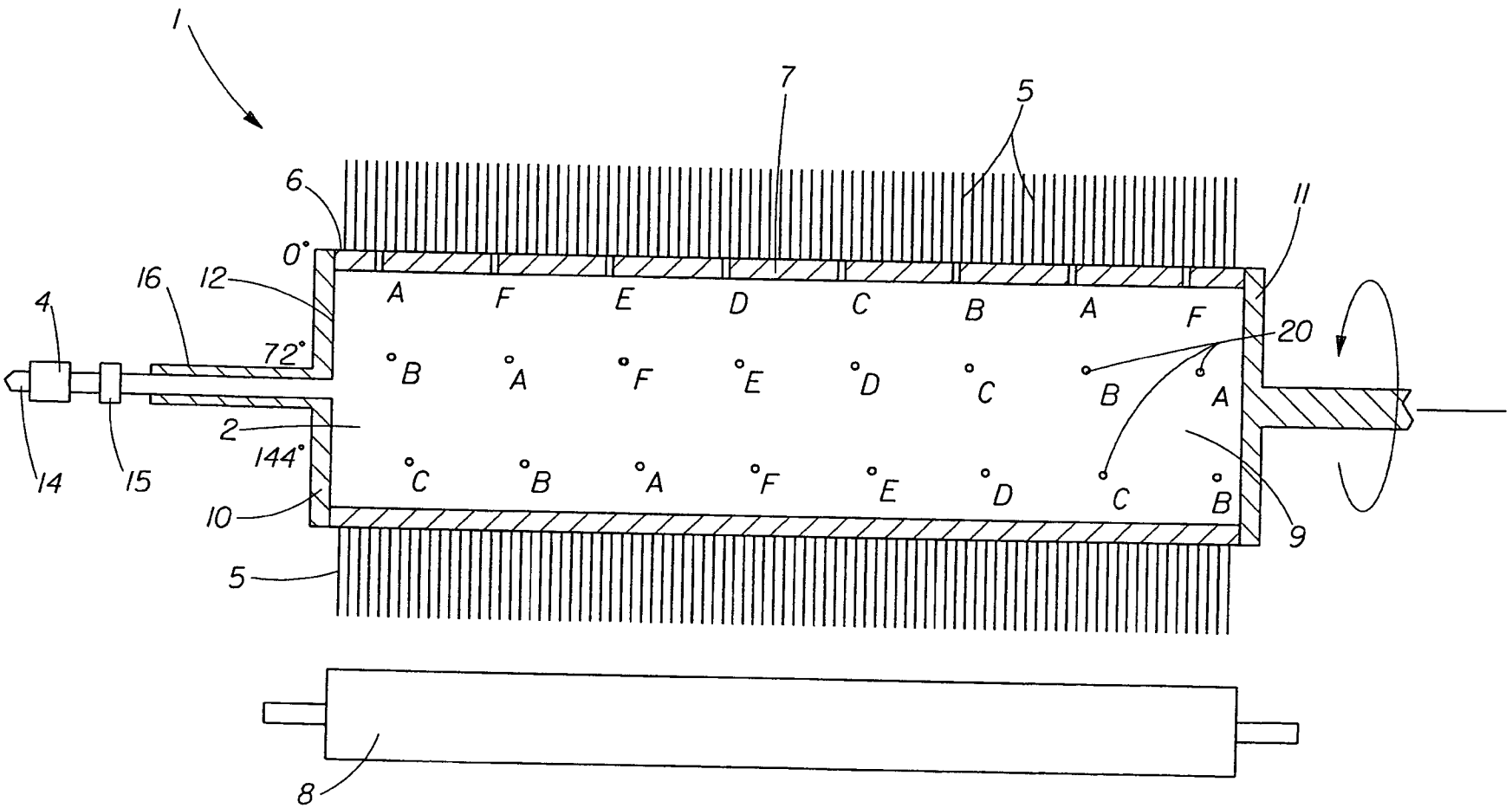
FIG. 3 is a cross sectional view of the brush of FIG. 1 along 3-3 showing apertures arranged in a helix pattern as shown on the internal surface of the peripheral wall of the brush.

Referring to FIG. 3, in one embodiment, the bristle carrying brush 1 is in the form of a hollow cylinder 2 comprising a peripheral wall 7, the peripheral wall 7 having an external surface 6 and an internal surface 9. The hollow cylinder 2 further comprises a closed first end 10 and a closed second end 11. The brush 1 comprises a plurality of apertures 20. Bristles 5 extend from the external surface 6 of the peripheral wall 7. The apertures 20 extend completely through the peripheral wall 7 of the hollow cylinder 2 of the brush 1, from the internal surface 9 to the external surface 6. The apertures 20 allow for steam to pass from the interior of the hollow cylinder 2 of brush 1, through the apertures 20 and emerge in the vicinity of the bristles 5 which are carried on the external surface 6 of the peripheral wall 7. Steam may be delivered to the inside of the hollow cylinder 2 by an inlet pipe 14 which may be attached to the brush 1. The inlet pipe 14 may have a steam delivery valve 4 and a shut off valve 15 all of which provides for the controlled flow of steam to be passed therethrough and into the inside of the hollow cylinder 2 so that the steam (or other fluid or gas) will emerge via the apertures 20 in the vicinity of the bristles 5.

The bristle-carrying brush 1 is in the form of a hollow cylinder 2 with bristles 5 carried on the external surface 6 of a peripheral wall 7 thereof. The brush may further comprise an extender 16 which may aid in supporting the brush 1 for rotation about its longitudinal axis. The bush 1 is supported for rotation and drivable about its longitudinal axis so that the bristles 5 are operable on a surface (or process surface) 8 lying substantially parallel to the axis of the brush 1. As the brush 1 rotates about its axis, the brush 1 passes across the width of the process surface 8 and is engaged by the bristles 5 of the brush.

In one embodiment the brush and method further comprises a shut off value 15 to initiate and cut off the supply of steam at the beginning and the end of each cleaning cycle. In one embodiment the steam as used herein cleans not only the process surface but also the brush 1 and bristles 5 of the brush.

Even though FIG. 3 shows the steam delivery valve 4 and the shut off valve 15, only on one side of the brush 1 (adjacent to the closed first end 10), it is to be understood that in another embodiment the steam delivery valve 4 and the shut off valve 15, may be located instead, adjacent to the closed second end 11. In another embodiment the steam delivery valve 4 and the shut off valve may be located adjacent to both the closed first end and the closed second end. Therefore, the liquid or gas may be delivered to both the closed first end 10 and the closed second end 11 of the brush 1.

The peripheral wall 7 has a first edge 12. In one embodiment the orientation and spacing of the first aperture 20 in a helix strand is based on the distance of the aperture from the first edge 12 of the peripheral wall 7. Apertures A, B, C, D, E, F, of FIG. 3 represent the first, second, third, forth, fifth, sixth helix strands respectively.

In one embodiment, the brush and method of the present invention deliver steam into the interior of the hollow cylinder 2 of a brush 1. Once the steam passes through the apertures 20, the steam (or other gas or liquid) thereby condenses either on the bristles 5 or in the vicinity of the bristles 5 via the steam passing through a plurality of apertures 20 in the peripheral wall 7 of the brush 1.

The apertures 20 may be arranged in any staggered multi helical pattern comprising from about 3 to about 15 helix, in another embodiment from about 3 to about 12, in another embodiment from about 4 to about 11 and in another embodiment from about 4 to about 6 helix strands. Without being limited by theory, by such features as herein disclosed, the invention ensures that the steam condenses into water and is applied as a very thin, continuous, consistent film to the process surface 8 in the region in which the process surface is engaged by the bristles rather than at a distance from such region. Improved effectiveness in cleaning is thereby achieved, while less steam is required than if it were applied to the surface at a distance from the brush. The present invention provides a great improvement in the reliability of the cleaning process and reduction of surface buildup on process surfaces.

Figure 4B:
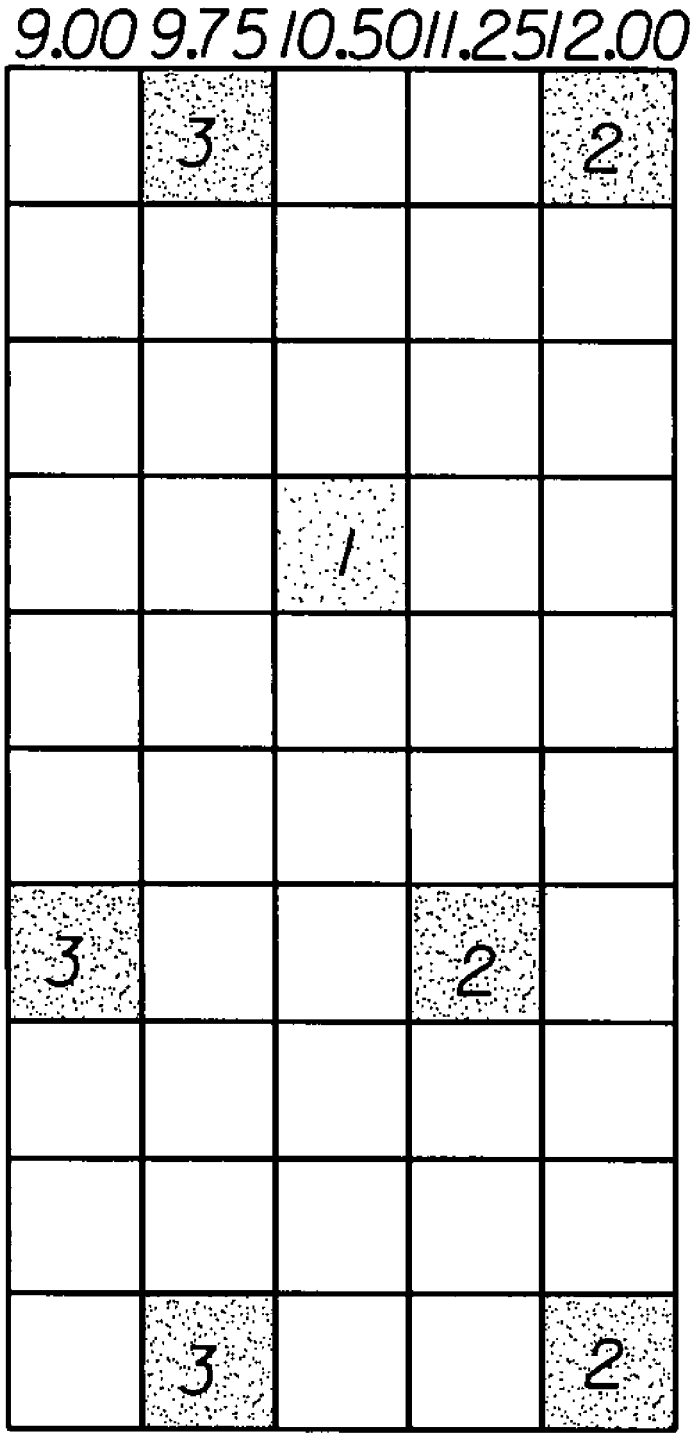
FIG. 4 is a view of an example of a quadra helix pattern that my be useful for the brush of the present invention, with a length of approximately 100 inches and a core diameter of approximately 2.556 inches. Because

Referring to FIG. 4, FIG. 4 represents an alternative embodiment of a staggered multi helical pattern useful for the brushes of the present invention. In FIG. 4 the apertures labeled numbers 1, 2, 3, and 4, represent the first, second, third, and forth, helix strands, respectively. The diameter of the inner peripheral wall of the brush may be about 2.556 inches. The circumferential offset between helical strand is about 120°. The orifice spacing within a helix is 3.0 inches, and the lateral offset between each helix strand and the adjacent helix strand is 0.75 inches.

FIG. 5 represents an alternative embodiment of a staggered multi helical pattern useful for the brushes of the present invention. Referring to FIG. 5 the apertures labeled numbers 1, 2, 3, 4, and 5 represent the first, second, third, forth, and fifth helix strands, respectively. For FIG. 5 the diameter of the inner peripheral wall is about 3.195 inches. The circumferential offset between helical strands is 90°. The orifice spacing within a helix is 2.40 inches, and the lateral offset between each helix strand and the adjacent helix strand is 0.48 inches. For FIG. 3 the core of the diameter of the inner peripheral wall is 3.75 inches. In an alternative embodiment the circumferential offset between helical strands is about 90°. The orifice spacing within a helix is about 2.40 inches, and the lateral offset between each helix strand and the adjacent helix strand is about 0.48 inches.

In another embodiment the helical pattern may comprise about 6 helix strands where in the diameter of the internal surface of the peripheral wall is about 3 to about 5 inches, in another embodiment about 3.8 inches. The circumferential offset between helical strand is about 72°. The orifice spacing within a helix strand is about 1 to about 3, or about 2.00 inches, and the lateral offset between each helix strand and the adjacent helix strand is about 0.2 to about 0.8 or about 0.3 inches.

In another embodiment the helical pattern may comprise about 7 helix strands wherein the diameter of the internal surface of the peripheral wall is about 4 to about 5 or about 4.47 inches. The circumferential offset between helical strands is from about 55°. to about 70°. or about 60°. The orifice spacing within a helix strand is about 1 to about 2 or about 1.714 inches, and the lateral offset between each helix strand and the adjacent helix strand is about 0.2 to about 0.4 or about 0.245 inches.

In another embodiment the brush 1 herein may be used to deliver a liquid or gas other than steam, for example mineral oil, anti-adhesion agent, surfactant based cleaners, etc.

The process surface to be cleaned may include a conveyor belt, printing plate, emboss roller, or marrying roll, etc. In one embodiment the surface to be cleaned is a emboss roller or other process surface used to emboss or form polymeric films or form other deformable materials. Examples of such process surfaces and films are disclosed in the following references: U.S. Pat. No. 5,662,758, Hamilton et al., U.S. Pat. No. 5,871,607, Hamilton et al., U.S. Pat. No. 6,194,062, Hamilton et al., U.S. Pat. No. 6,421,052, McGuire, U.S. Pat. No. 6,193,918, McGuire et al., U.S. Pat. No. 5,965,235 McGuire et al., U.S. Pat. No. 6,489,022, Hamilton et al., all of which are assigned to the Procter & Gamble Company.

In one embodiment the method of the present invention comprises a motor for effecting the rotating movement of the bristles 5 relative to the process surface 8 to be cleaned and provides an agitating cleaning action thereon. In one embodiment the brush rotates across the surface 8 to be cleaned, in a direction transverse to its axis of rotation. A belt attached to a motor and running round a pulley attached to the brush may be used to rotate the brush. Each end of the brush may be carried or supported on a respective one of a pair of screw-jacks, rotation of which cause movement across the process surface.

In one embodiment the method further comprises providing a heating element (e.g. heating coil) to heat water in a steamer reservoir and convert water into steam and an inlet pipe 14 to carry the steam from the steamer reservoir to the steam delivery valve 4 and then to the interior of the hollow cylinder 2 of brush 1. The steam delivery valve may be used to regulate the flow and the pressure of the steam. In one embodiment the pressure of the steam prior to entry into the interior of the hollow cylinder is from about 6 PSI to about 25 PSI, in another embodiment from about 7 to about 20 PSI and in yet another embodiment from about 8 to about 15 PSI.

Brush

In one embodiment the brushes useful herein are wound rope or cord bound brushes, particularly those disclosed in Enchelmaier U.S. Pat. No. 2,701,739, Feb. 8, 1955, Enchelmaier et al. U.S. Pat. No. 3,246,931, Apr. 19, 1966, and Enchelmaier U.S. Pat. No. 4,126,358, issued Nov. 21, 1978. In one embodiment of the present invention, the brushes produced are those which are sometimes referred to as "Fineset" brushes, wherein the bristles stand in even helical rows around the exterior surface of the peripheral wall of the brush.

In one embodiment, each of the bristles is in the form of a single substantially straight length of strand extending only from its inner, root end near the core to its outer end disposed radially outwardly of the brush core. All of the bristles in zones of substantial length axially in the brush core, the zones extending circumferentially of the brush, extend at substantially the same angle with respect to radii of the brush core.

In one embodiment, as discussed in Enchelmaier the bristles are held between the convolutions of one or more bristle-holding strands of cord, or the like helically wound on the brush core. The cords and bristle roots are bonded to the brush core by an adhesive with which the cords are impregnated on their way to the brush core and, alternatively, additionally by further adhesive supplied to the zone of the first engagement of the cords and bristle roots with the brush core.

In one embodiment the bristles are formed of nylon, stainless steel, brass, natural fibers (e.g. grass), etc.

In one embodiment the length of the brush herein is long enough to stretch from one side of the process surface to the other side of the process surface. In another embodiment the length of the brush is from about 1 ft to about 10 ft, in another embodiment from about 2 ft to about 6 ft.

In one embodiment, as typified in the above-references Enchelmaier U.S. Pat. No. 2,701,739, the brush bristles extend in longitudinal planes extending radially of the axis of the brush core, and brushes in which the bristles either (1) incline forwardly in the direction of rotation of the brush core or (2) incline rearwardly with respect to the direction of rotation of the brush core, and any combination of these features. Brushes of the above two types are of marked advantage in the treatment, for example, of certain types of flexible process surfaces.

In one embodiment the bristle length is from about 1 inch to about 5 inches, in another embodiment from about 1.25 to about 2 inches.

Brush Apertures

The brush herein comprises a plurality of apertures wherein the apertures are arranged in a staggered multi helical pattern. There may be any number of apertures of any required diameter spaced circumferentially and lengthwise around the peripheral wall 7 of the brush 1 to ensure satisfactory delivery of steam to the interior of the hollow cylinder 2 and thereafter the region in which the bristles 5 of the brush contact the process surface 8.

The brush in one embodiment comprises from about 20 to about 26 apertures, in another embodiment from about 23 to about 25 apertures, in yet another embodiment from about 23 to about 24 apertures, per linear foot of the brush.

In one embodiment the starting point for a quadra helix aperture pattern is 0.5 inch from the first edge 12, at 0 degrees peripheral circumference, 1 inch from the first edge at 90 degrees circumference, 0.75 inches from the first edge at 180 degrees circumference, and 2 inches from the first edge at 270 degrees circumference. In another embodiment the starting point for a penta helix aperture pattern is 0.75 inches from the first edge at 0 degrees circumference, 1.5 inch from the first edge at 72 degrees circumference, 2.25 inches from the first edge at 144 degrees circumference, 3 inches from the first edge at 217 degrees circumference, and 3.75 inches from the first edge at 288 degrees circumference.

In one embodiment the diameter of the internal surface of the peripheral wall is from about 2 inches to about 10 inches, in another embodiment from about 3 inches to about 8 inches.

In one embodiment the diameter of a single aperture is from about 0.03 inch to about 0.5 inches, in another embodiment from about 0.05 inch to about 0.2 inch, in yet another embodiment from about 0.06 inch to about 0.15 inch, and combinations of diameters within a brush. The diameter and size of the apertures may be varied within a helix strand or may be varied between helix strands. In one embodiment the diameter of all of the apertures for a brush are substantially equivalent.

In one embodiment the surface area ratio of the brush is from about 6 to about 30, in another embodiment from about 8 to about 13 or from about 9 to about 11. In one embodiment the surface area ratio if from about 6, 7, 8, 9, 10, 11 to about 10, 11, 12, 13, 14, 15, and any combination of these ranges.

As used herein "surface area ratio" means the ratio of the total surface area of the internal surface of the peripheral wall of the brush, excluding the first closed end and the second closed end, to the total surface area of the total aperture openings formed in the peripheral wall of the brush.

Optional Embodiments

In one embodiment the brush is disposed within and covered by a hood which is arranged to approach the process surface which is to be cleaned. Thereby steam emerging from the apertures on the peripheral wall of the brush, at locations not facing the process surface, is constrained and prevented from escape into the surrounding atmosphere. Therefore, steam may contact the surface being cleaned within the entire area of such a hood as well as in the comparatively small part of such area where the bristles engage the surface, further to enhance the cleaning operation.

In one embodiment, the apparatus comprises an extraction means for removing loosened dirt or water due to condensation of the steam, etc. from the surface being cleaned. Such extraction means may have at least one intake at one or more boundary(s) of the hood; thereby it will prevent excess steam from escaping at such boundary(s).

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

All percentages and ratios used hereinafter are by weight of total composition, unless otherwise indicated. All percentages, ratios, and levels of ingredients referred to herein are based on the actual amount of the ingredient, and do not include solvents, fillers, or other materials with which the ingredient may be combined as a commercially available product, unless otherwise indicated.

All measurements referred to herein are made at 25° C. unless otherwise specified.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A brush for cleaning a surface, the brush and surface comprising:

in combination, a surface to be cleaned, the surface having a width and being selected from the group consisting of, a conveyor belt, printing plate, emboss roller, or marrying roll, and a cleaning brush, the cleaning brush comprising a hollow cylinder having a closed first end, a closed second end, and a peripheral wall having an internal surface and an external surface;

a plurality of bristles arranged on the external surface of the peripheral wall;

wherein the hollow cylinder comprises a plurality of apertures formed in the peripheral wall and extending therethrough for permitting a gas or liquid to emerge from the interior of the hollow cylinder to the bristles and wherein the peripheral wall has a surface area ratio of from about 6 to about 30;

wherein the apertures are arranged in a staggered multi helical pattern comprising from about 3 to about 15 helixes; and wherein the hollow cylinder is rotatable and in parallel proximity to the surface such that when rotated the width of the surface is engaged by the bristles.

2. The brush of claim 1 wherein the ratio is from about 7 to about 15.

3. The brush of claim 2 wherein the ratio is from about 8 to about 13.

4. The brush of claim 3 wherein the ratio is from about 9 to about 11.

5. The brush of claim 2 having from about 4 to about 12 helixes.

6. The brush of claim 5 having from about 4 to about 6 helixes.

7. The brush of claim 6 having about 4 helixes.

8. The brush of claim 5 having from about 20 to about 25 apertures per linear foot of the hollow cylinder.

9. The brush of claim 8 having from about 23 to about 24 apertures per linear foot of the hollow cylinder.

10. The brush of claim 1 wherein the gas or liquid is steam.

11. The brush of claim 10 wherein a steam delivery valve is connected to the closed first end, the closed second end or both.

* * * * *